US007600828B2

(12) United States Patent
Chen et al.

(10) Patent No.: US 7,600,828 B2
(45) Date of Patent: Oct. 13, 2009

(54) SLIDE ASSEMBLY HAVING A HOMING DEVICE

(75) Inventors: Ken-Ching Chen, Kaohsiung Hsien (TW); Shih-Lung Huang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 12/003,086

(22) Filed: Dec. 20, 2007

(65) Prior Publication Data

US 2009/0160299 A1 Jun. 25, 2009

(51) Int. Cl.
*A47B 88/04* (2006.01)

(52) U.S. Cl. ..... 312/333; 312/319.1

(58) Field of Classification Search ..... 312/330.1, 312/334.1, 334.7, 334.8, 334.11, 334.16, 312/334.17, 334.44, 334.46, 334.47, 333, 312/319.1; 384/18, 20, 21, 22
See application file for complete search history.

(56) References Cited

U.S. PATENT DOCUMENTS

| | | | |
|---|---|---|---|
| 5,015,048 | A | 5/1991 | Brunnert |
| 5,020,868 | A | 6/1991 | Brunnert |
| 5,040,833 | A | 8/1991 | Brunnert |
| 5,040,858 | A | 8/1991 | Kruse et al. |
| 5,207,781 | A | 5/1993 | Rock |
| 5,240,318 | A | 8/1993 | Schroder et al. |
| 5,302,016 | A | 4/1994 | Lautenschlage et al. |
| 5,364,179 | A | 11/1994 | Brustle et al. |
| 5,474,375 | A | 12/1995 | Hollenstein et al. |
| 5,580,138 | A | 12/1996 | Grabher |
| 6,254,205 | B1 | 7/2001 | Wright et al. |
| 6,340,078 | B1 | 1/2002 | Scheible |
| 6,629,738 | B2 | 10/2003 | Salice |
| 6,652,050 | B2 | 11/2003 | Lin |
| 6,672,692 | B2 | 1/2004 | Weng |
| 6,712,435 | B2 | 3/2004 | Kim et al. |
| 6,733,097 | B2 | 5/2004 | Kim et al. |
| 6,736,471 | B2 | 5/2004 | Lin |
| 6,799,817 | B1 | 10/2004 | Chu |
| 6,846,053 | B2 | 1/2005 | Salice |
| 6,848,759 | B2 | 2/2005 | Doornbos et al. |
| 6,953,233 | B2 | 10/2005 | Lam et al. |
| 6,971,729 | B1 | 12/2005 | Kim et al. |

(Continued)

FOREIGN PATENT DOCUMENTS

EP 0743032 B1 11/1996

*Primary Examiner*—James O Hansen
(74) *Attorney, Agent, or Firm*—Rosenberg, Klein & Lee

(57) ABSTRACT

A slide assembly having a homing device includes a tie mount, a draw bar, a block, an elastic element and a pull unit. The slide assembly includes at least a first slide member and a second slide member. The tie mount is connected to the first slide member. The top and the bottom of the tie mount are formed with open slots, and the lateral of the tie mount is formed with a chute. The draw bar pierces through the open slots. The block, plugged by the draw bar, has a protruding cylinder corresponding to the chute. The elastic element is connected to the block. The pull unit is provided on the second slide member. The block corresponds to the pull unit, the second slide member, relative to the first slide member, is able to be homing in position automatically during its moving.

9 Claims, 7 Drawing Sheets

U.S. PATENT DOCUMENTS

| | | | | |
|---|---|---|---|---|
| 6,979,066 | B2 | 12/2005 | Yang | |
| 6,997,528 | B2 | 2/2006 | Yang | |
| 7,040,725 | B1 | 5/2006 | Mao-Chin | |
| 7,077,487 | B2 | 7/2006 | Yang | |
| 7,083,243 | B2 | 8/2006 | Lee | |
| 7,104,691 | B2 | 9/2006 | Chi | |
| 7,159,958 | B1 | 1/2007 | Lu | |
| 7,244,005 | B1 | 7/2007 | Lu | |
| 7,249,813 | B2 | 7/2007 | Gasser | |
| 7,347,515 | B1 * | 3/2008 | Lu | 312/333 |
| 2004/0183411 | A1 | 9/2004 | Boks | |
| 2004/0239218 | A1 | 12/2004 | Jurja | |
| 2005/0093406 | A1 * | 5/2005 | Yang | 312/333 |
| 2005/0104492 | A1 | 5/2005 | Chiu | |
| 2005/0231083 | A1 | 10/2005 | Garcie | |
| 2006/0043851 | A1 | 3/2006 | Lee | |
| 2006/0082266 | A1 | 4/2006 | Le et al. | |
| 2006/0108901 | A1 | 5/2006 | Mao-Chin | |
| 2006/0186772 | A1 | 8/2006 | Lam et al. | |
| 2006/0238089 | A1 | 10/2006 | Prentner et al. | |
| 2007/0001562 | A1 | 1/2007 | Park | |
| 2007/0046158 | A1 | 3/2007 | Hoffman | |
| 2007/0132346 | A1 | 6/2007 | Huang | |
| 2007/0188060 | A1 | 8/2007 | Nussbaumer et al. | |

* cited by examiner

SLIDE ASSEMBLY HAVING A HOMING DEVICE

BACKGROUND OF THE INVENTION

1. Field of the Invention

The present invention relates to a slide assembly having a homing device, and more particularly to a movable second slide member coupled to a fixed first slide member that enables an automatic homing collection during the end of its moving.

2. Description of the Prior Art

As ordinary drawers or the like are activated to engage in a horizontal slip by means of a slide, the whole movements of outwardly pulling out and inwardly pushing in are done by the exertion of the user. Besides, products of slides featuring automatically homing collection are off the shelf, where the automatically homing slide enables a draw, at its inward movement by a push, to return automatically back to its accommodation of a cabinet exactly during the end of its moving.

The foregoing mentioned slides with an automatically homing collection are among the recent issued patents, for instance the U.S. Pat. Nos. 7,040,725 B1, 7,077,487 B2, 7,083,243 B2, 7,104,691 B2 and 7,244,005 B1.

The present invention is categorized into the foregoing product group, yet somehow, it features much more strength in the market competition while economical in practical use.

SUMMARY OF THE INVENTION

The objective of the present invention is to provide a slide assembly having a homing device to enable the slide assembly to incorporate automatically, where its mechanism is sure to respond precisely, and the function persists unbounded and the usage lasts long enough.

According to the present invention, there is provided a slide assembly having a homing device, comprising:

the slide assembly comprising at least a first slide member and a second slide member, the second slide member sliding in the first slide member;

a tie mount connected to the first slide member, the tie mount having a top, a lateral and a bottom, the top and the bottom having open slots, the lateral having a chute, the chute having a receding section and a parking section at respective ends, the receding section and the parking section being curved toward the top of the tie mount;

a draw bar, the draw bar piercing through the open slots;

a block, plugged by the draw bar and integrated thereon, having a protruding cylinder corresponding to the chute;

an elastic element, the elastic element having a first end and a second end, the first end being a fixed end and the second end being connected to the block; and a pull unit provided at a rear end of the second slide member, the pull unit comprising sequentially an entrance, a first guiding section, a first catch, a second catch and a second guiding section;

thereby the block corresponding to the pull unit, the second slide member enabling an automatic homing collection relative to the first slide member.

Preferably, the tie mount is provided with limbs and an orifice, the first slide member having clamps and a mounting hole corresponding in position to the limbs and the orifice, the tie mount further comprising a locking pin corresponding to the orifice and the mounting hole.

Preferably, the first slide member is provided with barriers spaced according to the width of the tie mount.

Preferably, the tie mount is provided with a first hook connecting to the first end of the elastic element.

Preferably, the first slide member is provided with a second hook connecting to the first end of the elastic element.

Preferably, the block is provided with a joint post connecting to the second end of the elastic element.

Preferably, the pull unit has the first guiding section to be a tilt and the second guiding section to be a curve.

Preferably, the pull unit is integrally formed with the second slide member.

Alternatively, the pull unit is a separate piece installed to the second slide member.

Accordingly, the present invention has the following improved functions and advantages:

a. The draw bar is vertically sliding which makes its guiding stable, and it further enables the horizontal mobility of the block to have precise position relative to the chute and the pull unit.

b. The block is plugged by the draw bar and pulled by the elastic element, where the stability of its position can be enhanced by the introduced friction of the draw bar.

c. The connection between the pull unit and the block and the seizure of the block in the parking section of the chute, are hard to be extinct.

DETAILED DESCRIPTION OF THE PREFERRED EMBODIMENTS

Figure 1:
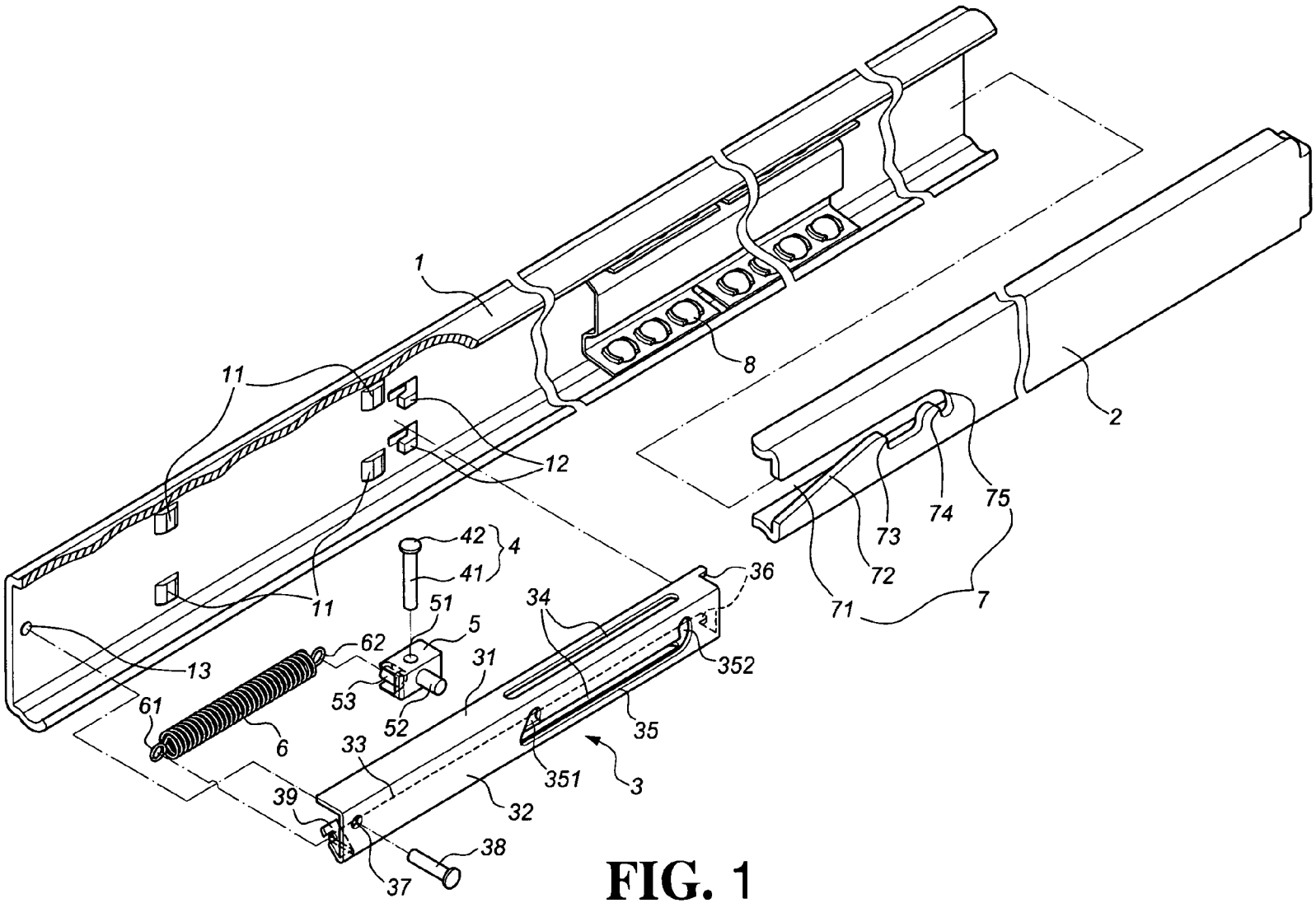
FIG. 1 is an exploded view of a first embodiment of the present invention (the slide assembly including at least a first slide member and a second slide member)
Figure 2:
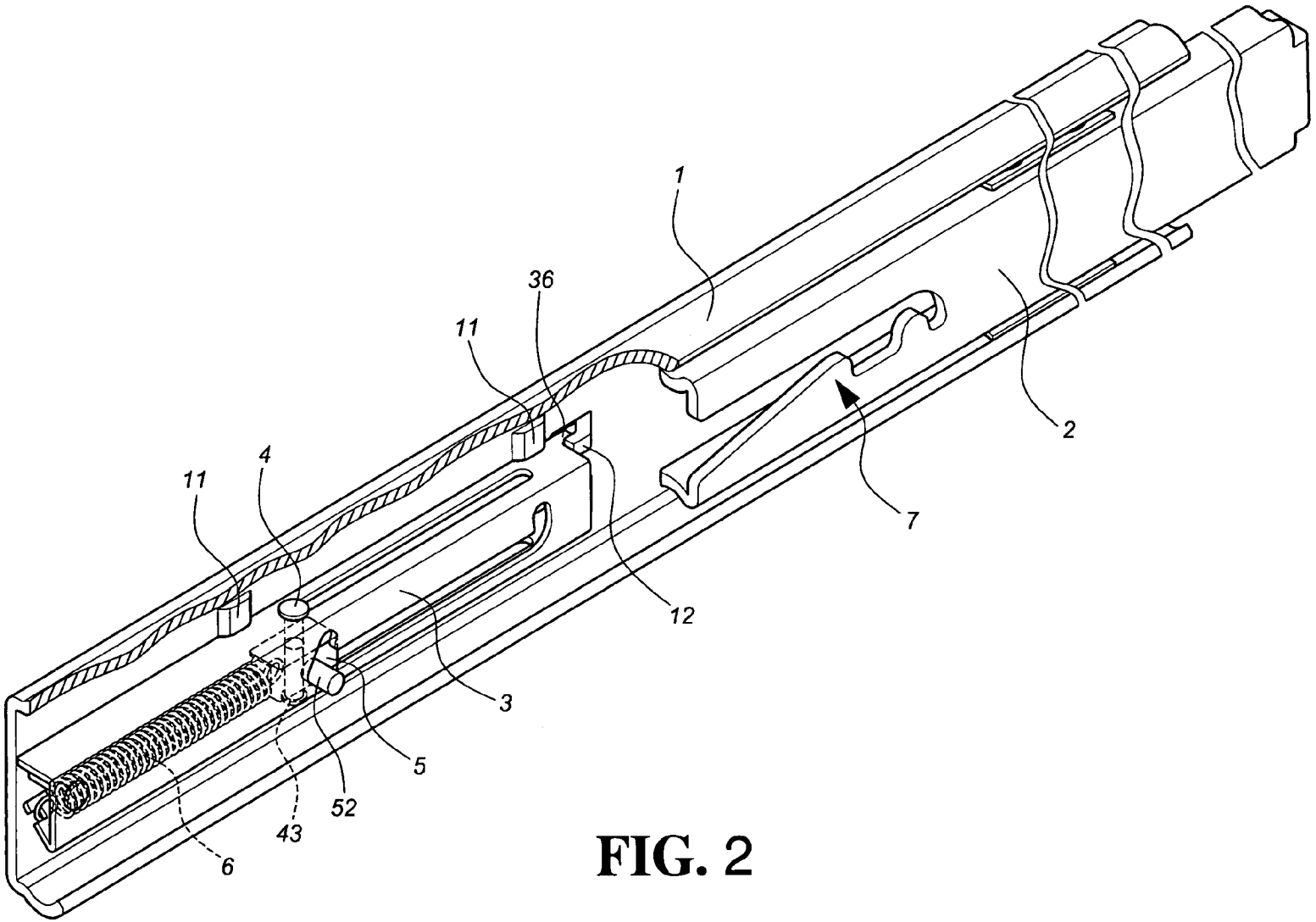
FIG. 2 is a perspective view of the first embodiment of the present invention.

As shown in FIGS. 1 & 2, a first embodiment of the present invention comprises a first slide member 1, a second slide member 2, a tie mount 3, a draw bar 4, a block 5, an elastic element 6 and a pull unit 7.

The first slide member 1 comprises a bearing 8, barriers 11, clamps 12 and a mounting hole 13 therein. The barriers 11 are spaced according to the width of the tie mount 3.

The second slide member 2, connected to the bearing 8, expands and contracts to slide relatively to the first slide member 1.

The tie mount 3 is connected to the first slide member 1. The tie mount 3 has a top 31, a lateral 32 and a bottom 33. The top 31 and the bottom 33 have open slots 34 corresponding to each other. The lateral 32 has a chute 35. The chute 35 has a receding section 351 and a parking section 352 at its both ends respectively. The receding section 351 and the parking section 352 are curved toward the top 31. The tie mount 3 has limbs 36 and an orifice 37 corresponding in position to the clamps 12 and the mounting hole 13 of the first slide member 1, respectively. The tie mount 3 is confined by the barriers 11 of the first slide member 1. The clamps 12 engage with the limbs 36. A locking pin 38 is provided for the fastening purpose by piercing through the orifice 37 and the mounting hole 13. Besides, the tie mount 3 is provided with a first hook 39.

The draw bar 4 has a rod 41 and a cap 42 on the top of the rod 41. The rod 41 pierces through the open slots 34 of the tie mount 3. The cap 42 and the bottom of the rod 41 are pushed against the top 31 and the bottom 33. The rod 41 is able to slide along the open slots 34. The bottom of the rod 41 can be a flattened enlarged end 43, as shown in FIG. 2.

The block 5 has a through hole 51 to be plugged by the rod 41 of the draw bar 4, which together to engage a slide. The block 5 has a protruding cylinder 52 which is for piercing across the chute 35 of the tie mount 3. The block 5 further comprises a joint post 53.

The elastic element 6 has a first end 61 and a second end 62. The first end 61 is connected to the first hook 39 of the tie mount 3, and the second end 62 is connected to the joint post 53 of the block 5.

The pull unit 7 is integrally formed with a rear end of the second slide member 2. The pull unit 7 includes sequentially an entrance 71, a first guiding section 72, a first catch 73, a second catch 74 and a second guiding section 75. The first guiding section 72 is a tilt while the second guiding section 75 is a curve.

Figure 3:
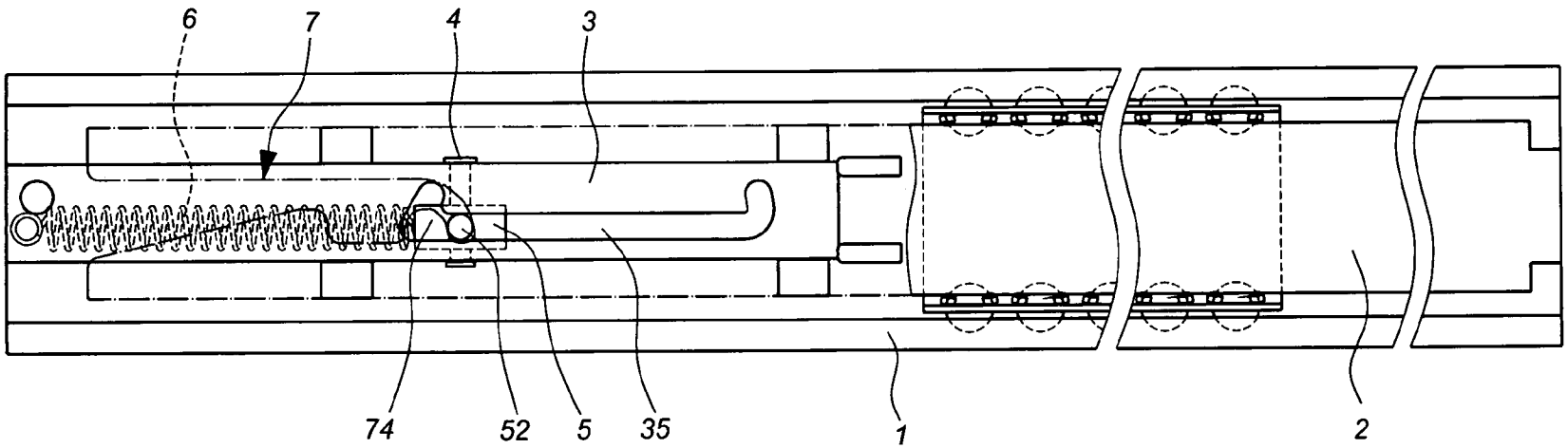
FIG. 3 is a schematic diagram of the appearance of the complete homing collection of the first embodiment of the present invention.

FIG. 3 shows the second slide member 2 is in homing collection in the first slide member 1. The block 5 and the draw bar 4 are subject to the pulling force of the elastic element 6 to locate at the back section of the chute 35 of the tie mount 3. The protruding cylinder 52 of the block 5 engages with the second catch 74 of the pull unit 7 of the second slide member 2, which enables the second slide member 2 to be homing in the first slide member 1 and parked automatically.

Figure 4:
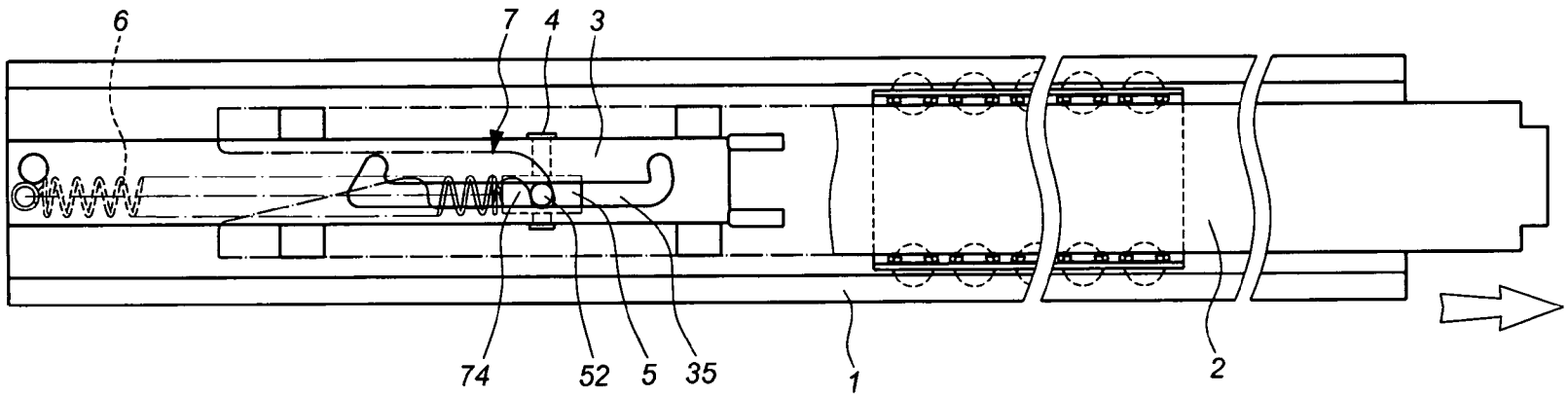
FIG. 4 is the first operational schematic representation of the first embodiment of the present invention (normal operation: the pull unit drags the block)

FIG. 4 shows that the second slide member 2 is pulled out a distance relative to the first slide member 1. The second slide member 2 drags the block 5 and the draw bar 4 by the second catch 74 of the pull unit 7, and the elastic element 6 is in an expanded status.

Figure 5:
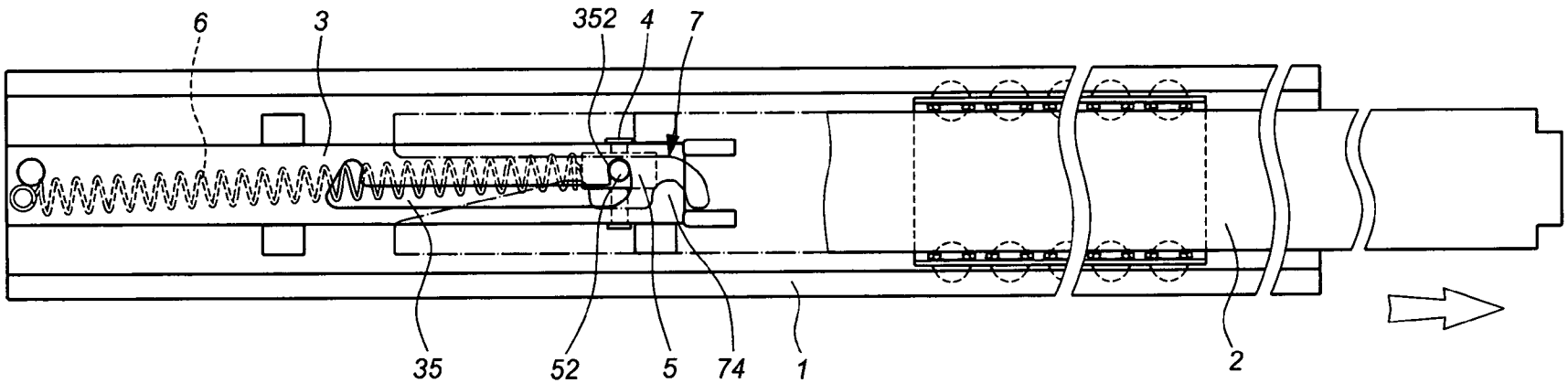
FIG. 5 is the second operational schematic representation of the first embodiment of the present invention (normal operation: the block lodges in the parking section)

FIG. 5 shows a further pull of the second slide member 2 relative to the first slide member 1 to arrive at the parking section 352 of the chute 35. The block 5, together with the draw bar 4, slides with the protruding cylinder 52 along the chute 35 into the parking section 352 for a stop, and the protruding cylinder 52 of the block 5 disengages from the second catch 74 of the pull unit 7. Subsequently, (not shown in the drawings) the second slide member 2 is pulled out to its extremity.

Figure 6:
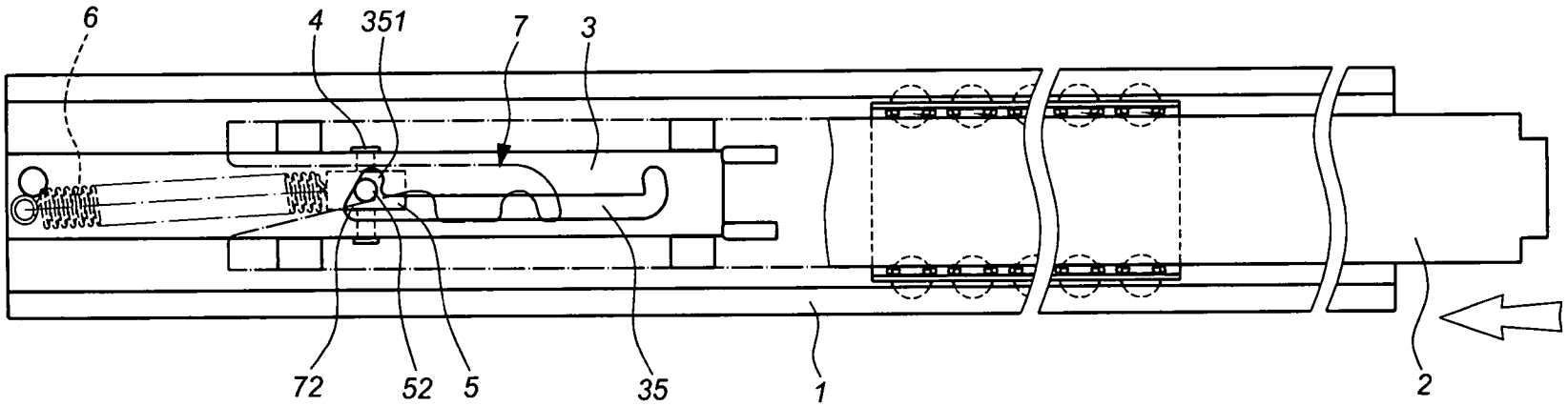
FIG. 6 is the third operational schematic representation of the first embodiment of the present invention (abnormal operation: the block rebounds and the pull unit moves again toward the block)
Figure 7:
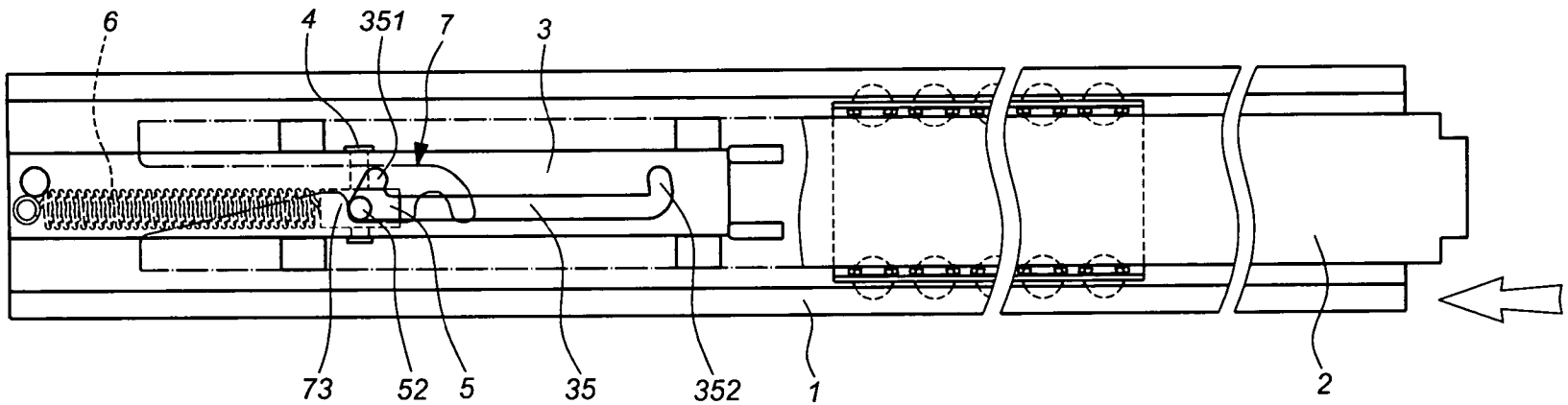
FIG. 7 is the fourth operational schematic representation of the first embodiment of the present invention (abnormal operation being fixed: the pull unit is pushed back to have its first catch engaging with the protruding cylinder of the block)

During abnormal operations, for instance, as the block 5 is accidentally sprung to the receding section 351 of the chute 35. To fix the problem, as shown in FIG. 6, the second slide member 2 is pushed back, followed by pushing the protruding cylinder 52 of the block 5 into the receding section 351 by the first guiding section 72 of the pull unit 7. As shown in FIG. 7, the protruding cylinder 52 engages with the first catch 73 of the pull unit 7, and the second slide member 2 is then pulled out to carry the block 5 to the parking section 352 of the chute 35.

Figure 8:
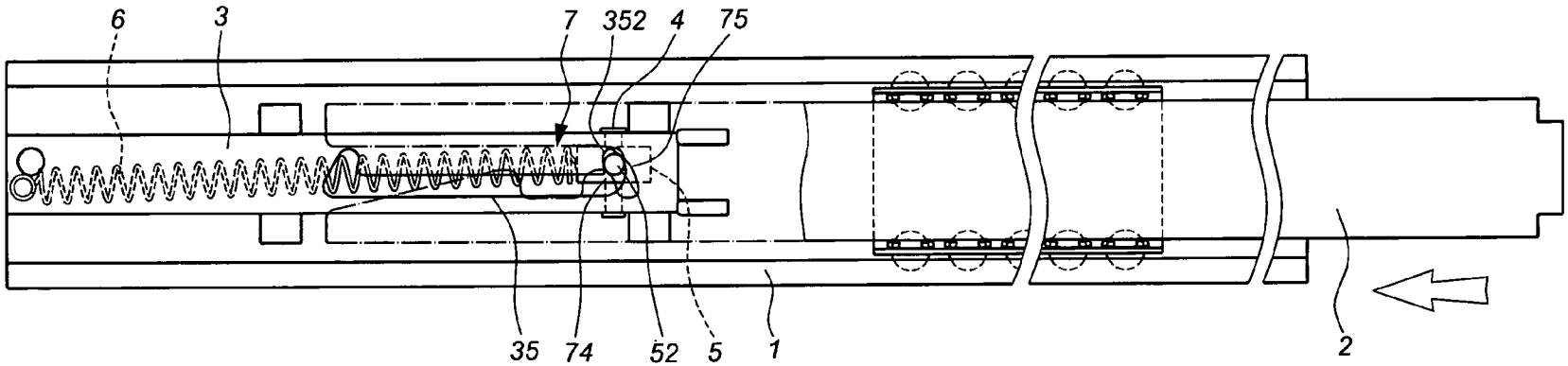
FIG. 8 is the first operational schematic representation of the homing collection of the first embodiment of the present invention (the protruding cylinder of the block engages with the second catch of the pull unit)
Figure 9:
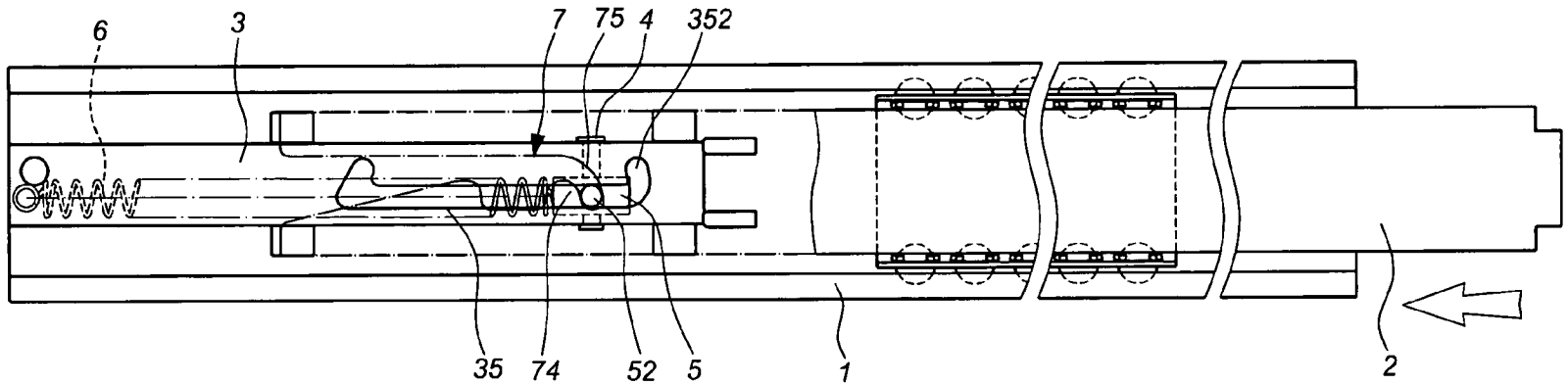
FIG. 9 is the second operational schematic representation of the homing collection of the first embodiment of the present invention (the block together with the pull unit drags the second slide member by means of the elastic element)

Once the second slide member 2 is again put in homing position, as in FIG. 8, the pull unit 7 approaches to the block 5, where the second guiding section 75 of the pull unit 7 guides the protruding cylinder 52 disengaging from the parking section 352 of the chute 35. Accordingly, the protruding cylinder 52 moves to the second catch 74 of the pull unit 7, then, as shown in FIG. 9, the block 5 pulls the second slide member 2 in the first slide member 1 by means of the elastic force of the elastic element 6.

Figure 10:
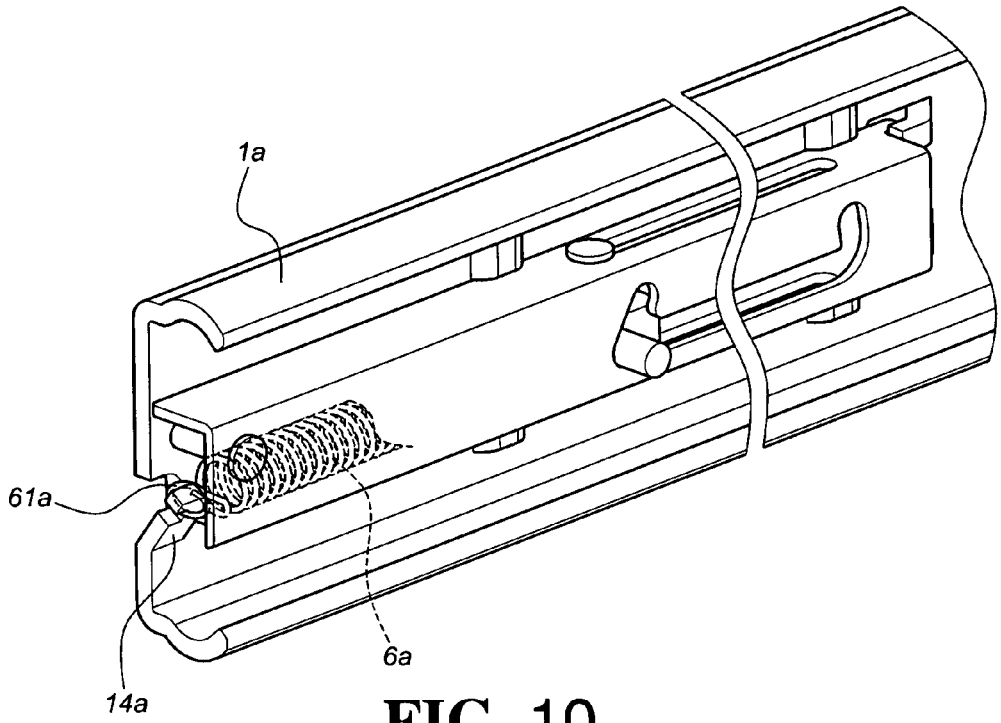
FIG. 10 is a partly structure view showing a second embodiment of the present invention (the first slide member connects to the elastic element)

Another embodiment of the joint of the first slide member with the elastic element of the partly structure of the present invention is in FIG. 10, and the fixing of an elastic element 6*a*, as an equivalent embodiment, where a first slide member 1*a* is provided with a second hook 14*a* which is corresponding and connecting to a first end 61*a* of the elastic element 6*a*.

Figure 11:
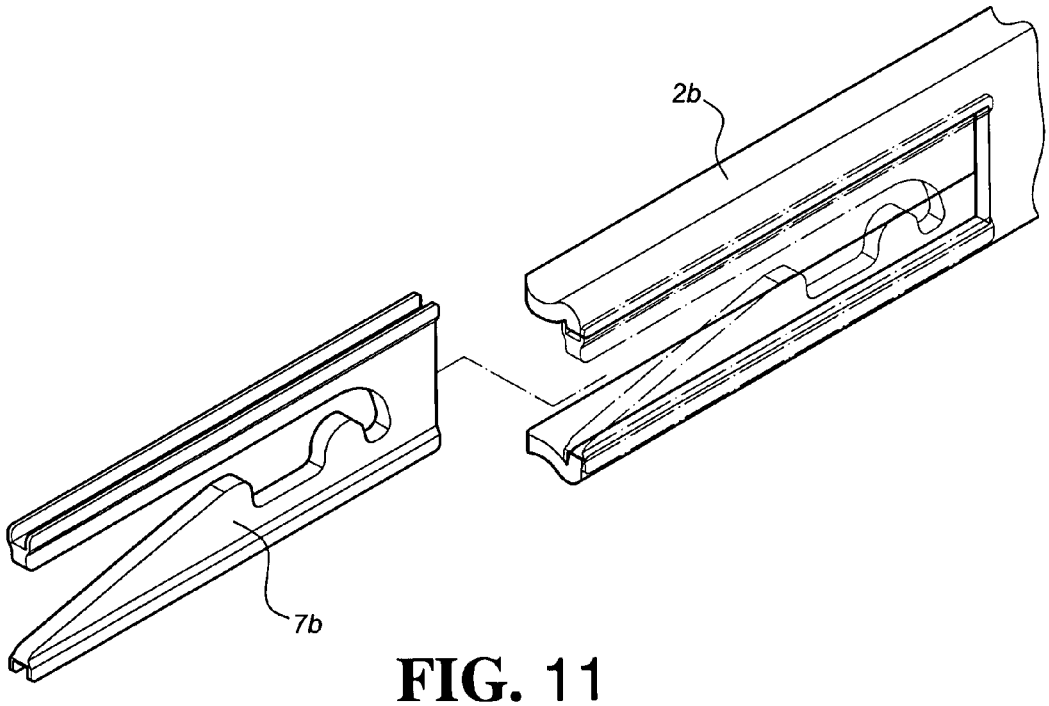
FIG. 11 is a partly structure view showing a third embodiment of the present invention (the pull unit is a separate piece).

The other embodiment of the pull unit appearing as a separate piece of the partly structure of the present invention is in FIG. 11, an equivalent embodiment of a pull unit 7*b*, where the pull unit 7*b* is a separate piece and assembled to a second slide member 2*b*; during a usage, for instance, the pull unit 7*b* can be a different substance from that of the second slide member 2*b*.

What is claimed is:

1. A slide assembly having a homing device, comprising:

the slide assembly comprising at least a first slide member and a second slide member, the second slide member sliding in the first slide member;

a tie mount connected to the first slide member, the tie mount having a top, a lateral and a bottom, the top and the bottom having open slots, the lateral having a chute, the chute having a receding section and a parking section at respective ends, the receding section and the parking section being curved toward the top of the tie mount;

a draw bar, the draw bar piercing through the open slots;

a block, plugged by the draw bar and integrated thereon, having a protruding cylinder corresponding to the chute;

an elastic element, the elastic element having a first end and a second end, the first end being a fixed end and the second end being connected to the block; and a pull unit provided at a rear end of the second slide member, the pull unit comprising sequentially an entrance, a first guiding section, a first catch, a second catch and a second guiding section;

thereby the block corresponding to the pull unit, the second slide member enabling an automatic homing collection relative to the first slide member.

2. The slide assembly having a homing device according to claim 1, wherein the tie mount is provided with limbs and an orifice, the first slide member having clamps and a mounting hole corresponding in position to the limbs and the orifice, the tie mount further comprising a locking pin corresponding to the orifice and the mounting hole.

3. The slide assembly having a homing device according to claim 1, wherein the first slide member is provided with barriers spaced according to the width of the tie mount.

4. The slide assembly having a homing device according to claim 1, wherein the tie mount is provided with a first hook connecting to the first end of the elastic element.

5. The slide assembly having a homing device according to claim 1, wherein the first slide member is provided with a second hook connecting to the first end of the elastic element.

6. The slide assembly having a homing device according to claim 1, wherein the block is provided with a joint post connecting to the second end of the elastic element.

7. The slide assembly having a homing device according to claim 1, wherein the pull unit has the first guiding section to be a tilt and the second guiding section to be a curve.

8. The slide assembly having a homing device according to claim 1, wherein the pull unit is integrally formed with the second slide member.

9. The slide assembly having a homing device according to claim 1, wherein the pull unit is a separate piece installed to the second slide member.

* * * * *